US012320213B2

(12) United States Patent
Hernandez

(10) Patent No.: US 12,320,213 B2
(45) Date of Patent: Jun. 3, 2025

(54) ELECTRONIC LIMIT BARRIER FOR HYDRAULIC POWER TONGS

(71) Applicant: Weatherford Technology Holdings, LLC., Houston, TX (US)

(72) Inventor: Edinson G. Hernandez, Houston, TX (US)

(73) Assignee: Weatherford Technology Holdings, LLC., Houston, TX (US)

( * ) Notice: Subject to any disclaimer, the term of this patent is extended or adjusted under 35 U.S.C. 154(b) by 172 days.

(21) Appl. No.: 18/352,704

(22) Filed: Jul. 14, 2023

(65) Prior Publication Data

US 2025/0020031 A1 Jan. 16, 2025

Related U.S. Application Data

(60) Provisional application No. 63/513,470, filed on Jul. 13, 2023.

(51) Int. Cl.
*E21B 19/16* (2006.01)

(52) U.S. Cl.
CPC ..... *E21B 19/165* (2013.01); *E21B 19/161* (2013.01)

(58) Field of Classification Search
CPC ..... E21B 19/165; E21B 19/166
See application file for complete search history.

(56) References Cited

U.S. PATENT DOCUMENTS 4,552,041 A * 11/1985 Coyle, Sr. ..... E21B 19/166 81/470
4,579,024 A * 4/1986 Coyle, Sr. ..... E21B 19/166 173/177
5,535,645 A * 7/1996 Penisson ..... E21B 19/16 81/57.33
11,525,315 B2 * 12/2022 Helms ..... E21B 19/16
2003/0205112 A1 * 11/2003 Hawkins, III ..... E21B 19/163 81/57.34
2012/0323500 A1 * 12/2012 Prefontaine ..... E21B 19/166 702/41
2015/0275597 A1 * 10/2015 Thibodeaux ..... E21B 19/164 81/57.33
2019/0055796 A1 * 2/2019 Zimbelmann ..... E21B 19/161
2019/0078426 A1 * 3/2019 Zheng ..... E21B 44/00
2020/0224525 A1 * 7/2020 Parmeshwar ..... E21B 44/00
2020/0224526 A1 * 7/2020 Parmeshwar ..... E21B 47/024
2020/0347714 A1 * 11/2020 Kilic ..... E21B 47/12
2021/0010365 A1 1/2021 Botnan et al.
2022/0120146 A1 4/2022 Holck
2022/0268113 A1 8/2022 Owoeye et al.

* cited by examiner

*Primary Examiner* — Blake Michener

(74) *Attorney, Agent, or Firm* — Vorys, Sater, Seymour and Pease LLP

(57) ABSTRACT

A system includes hydraulic power tongs mounted to a rig floor and including a primary tong and one or more controls for operating the primary tong, an electronic limit barrier device including one or more sensors operable to determine a distance between the hydraulic power tongs and an operator on the rig floor, and a hydraulic control valve in communication with the electronic limit barrier device and fluidly coupled to the hydraulic power tongs. The electronic limit barrier device is programmed to compare the distance to a pre-defined cutoff distance, and release hydraulic fluid from the hydraulic power tongs upon determining that the distance is less than or equal to the pre-defined cutoff distance.

20 Claims, 4 Drawing Sheets

ELECTRONIC LIMIT BARRIER FOR HYDRAULIC POWER TONGS

FIELD OF THE DISCLOSURE

The present disclosure relates generally to operating power tongs used in oil and gas drilling rigs and, more particularly, to proximity-based user detection for hydraulic power tong safety.

BACKGROUND OF THE DISCLOSURE

During drilling rig floor operations in oil and gas wells, it is often necessary to provide large amounts of torque to tubulars and move heavy, sizeable equipment. To this end, large-capacity self-locking wrenches called "power tongs" are utilized to enable an operator to move and torque drilling equipment and tubulars. These power tongs are commonly employed for assembling (or "making up") or disassembling (or "breaking") casing tubulars, drill strings, and production tubulars. Power tongs commonly rely on hydraulic power for the provision of torque and dependable grip strength in rig floor operations. The power tongs may be hung from existing rig lines or may be installed on self-contained frames which may be moved on the rig floor. The hydraulic power may be provided by an internal hydraulic system on the power tong or from pre-existing hydraulic lines and rig supply.

Hydraulic power tongs may be cumbersome to deploy and move on a rig floor, and these rig floors are commonly covered in excess drilling fluids, production fluids, lubricants, and other friction-reducing fluids. Between the unstable conditions on the rig floor, the repetitive nature of the work, and the high power of the tooling, hydraulic power tong operations may present an increased risk of injury. Undesired rotation or actuation of the hydraulic power tongs can lead to operator injury or death, and unstable footing on the rig floor can cause inadvertent operation or loss of control of the hydraulic power tongs.

Accordingly, a safety barrier between the operator and the hydraulic power tong is desirable to prevent injury during rig floor operations.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system includes hydraulic power tongs mounted to a rig floor and including a primary tong and one or more controls for operating the primary tong, an electronic limit barrier device including one or more sensors operable to determine a distance between the hydraulic power tongs and an operator on the rig floor, and a hydraulic control valve in communication with the electronic limit barrier device and fluidly coupled to the hydraulic power tongs. The electronic limit barrier device is programmed to compare the distance to a pre-defined cutoff distance, and release hydraulic fluid from the hydraulic power tongs upon determining that the distance is less than or equal to the pre-defined cutoff distance.

In another embodiment, a method includes activating an electronic limit barrier device on a rig floor including hydraulic power tongs, monitoring a distance between an operator on the rig floor and the hydraulic power tongs using one or more sensors included in the electronic limit barrier device, and determining with a controller of the electronic limit barrier device if the distance is less than or equal to a pre-defined cutoff distance. The method further includes sending a cut-off signal to a hydraulic control valve with the controller when the distance is less than or equal to the pre-defined cutoff distance, and releasing hydraulic fluid from the hydraulic power tongs upon receipt of the cut-off signal, and thereby disabling the hydraulic power tongs.

In a further embodiment, an electronic limit barrier device includes one or more sensors configured to determine a distance between the electronic limit barrier device and an operator present on a rig floor that includes hydraulic power tongs, and a controller communicably coupled to the one or more sensors and a hydraulic control valve. The controller is programmed to generate a cut-off signal to the hydraulic control valve based upon the distance determined by the one or more sensors, and the cut-off signal triggers release of hydraulic fluid to the hydraulic power tongs via the hydraulic control valve.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
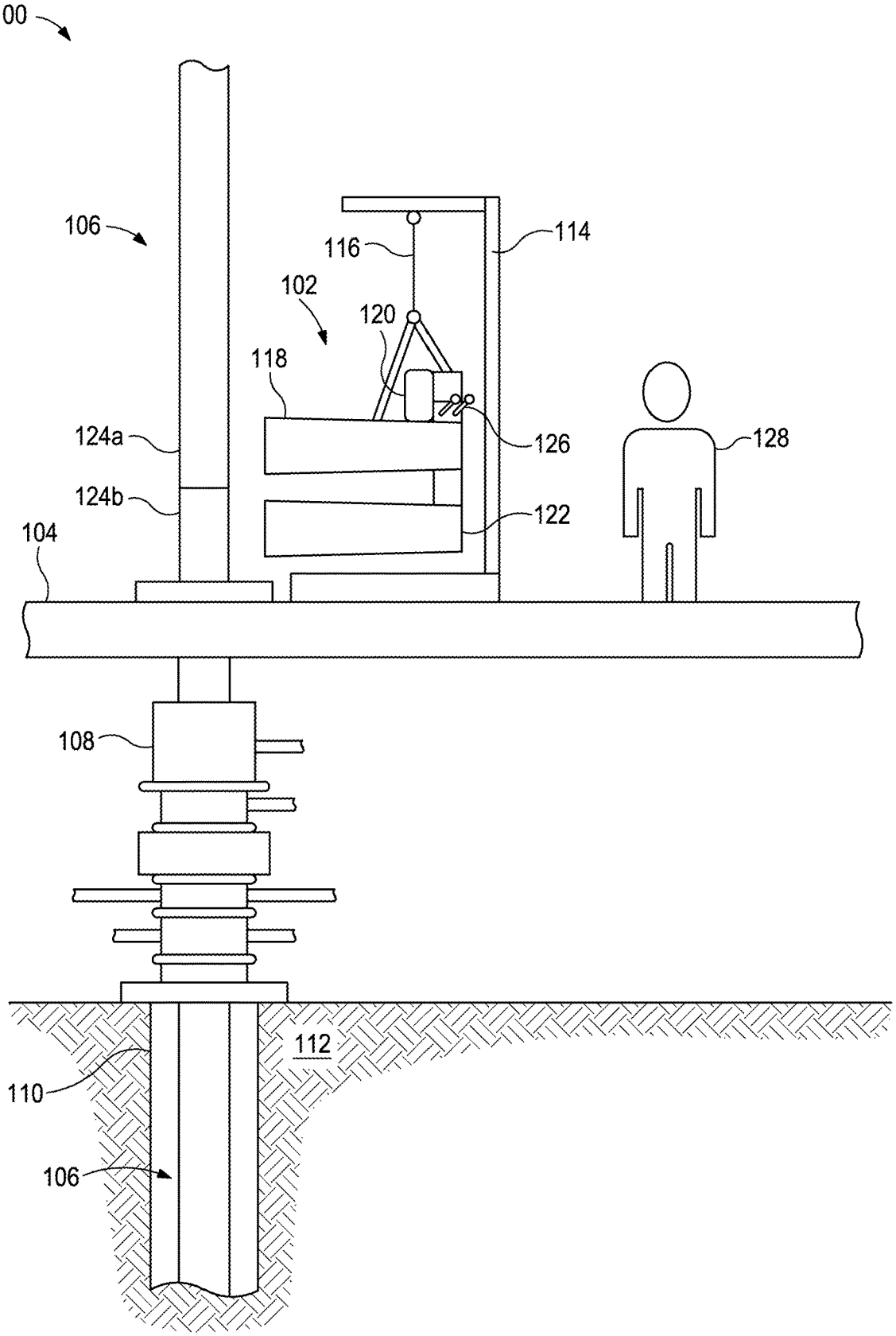
FIG. 1 is a schematic view of a rig floor with deployed hydraulic power tongs for drilling operations.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to operating power tongs in oil and gas drilling rigs and, more particularly, to proximity-based user detection for hydraulic power tong safety. Embodiments disclosed herein may include an electronic device and system for generating a safety barrier between an operator and hydraulic power tongs. The device may utilize ultrasonic and/or infrared sensors for determining operator proximity, and may be configured to generate a cut-off signal for a hydraulic dump valve when an operator breaches a proximity limit or predetermined distance from the power tongs. The device may be retrofitted onto existing hydraulic power tong systems without modification or intervention. Embodiments disclosed herein may further include a method of operating hydraulic power tongs including installation of an electronic safety barrier, determination of operator distances via sensors, and releasing hydraulic fluid to deactivate a hydraulic system based on sensor data.

FIG. 1 is a schematic view of an example well system 100 that includes hydraulic power tongs 102 for handling downhole pipes or tubing used in the oil and gas industry. The hydraulic power tongs 102 may be mounted to or otherwise deployed on a rig floor 104, which may be in active use for drilling or well completion operations. The hydraulic power tongs 102 may be utilized in assembling, breaking, or running downhole pipe or "tubulars" 106. The tubulars 106 may include, but are not limited to, production tubing, well casing (liner), drill pipe, drilling risers, sucker rods, or any combination thereof. The tubular 106 may extend past (through) the rig floor 104 into a wellhead 108. The wellhead 108 may comprise a plurality of valves, hangers, heads, and plugs to facilitate well drilling and completion operations. The wellhead 108 may cap a wellbore 110 which has been, or is actively being, drilled within the earth 112. The hydraulic power tongs 102 may be used to help run the tubular 106 through the wellhead 108 and into the wellbore 110 below, such that subterranean operations may be performed.

As illustrated in FIG. 1, the hydraulic power tongs 102 may be secured to or hung from a frame 114 for deployment on the rig floor 104. The frame 114 may be translatable (movable) on the rig floor 104 for use in drilling and production operations performed on the tubular 106. The translatability of the frame 114 may enable the hydraulic power tongs 102 to be advanced towards the tubular 106 as needed, and backed off once an operation has been performed. In alternate embodiments, however, the hydraulic power tongs 102 may be hung from an existing rig arm which may be present within the well system 100. The hydraulic power tongs 102 may be coupled to the frame 114 (or a rig arm) via one or more cables 116. In some embodiments, the one or more cables 116 may include structural cables for hanging the hydraulic power tongs 102 as well as hydraulic lines for external provision of hydraulic fluid.

The hydraulic power tongs 102 may include a primary tong 118 which is utilized in providing grip and torque to the tubular 106 during operations. The primary tong 118 may provide rotation to thread or unthread the tubulars during assembly or disassembly, respectively. During operation, the primary tong 118 may translate vertically within the hydraulic power tongs 102 to account for thread travel during operation. The primary tong 118 may employ hydraulic power for gripping the tubular 106, as well as for generating torque on the tubular 106 via rotational components. The primary tong 118 may receive hydraulic fluid and power from a hydraulic pump 120 which may be included with the hydraulic power tongs 102. The hydraulic pump 120 may receive hydraulic fluid from an internal reservoir (not shown) on the hydraulic power tongs 102, or from an external reservoir (not shown) connected by a hydraulic line.

The hydraulic power tongs 102 may further include a backup tong 122 which may be disposed vertically below the primary tong 118. The backup tong 122 may provide grip and stability while handling the tubular 106. The backup tong 122 may also be hydraulically powered, and may be in fluid communication with the hydraulic pump 120 for provision of hydraulic fluid. In the illustrated embodiments, the tubular 106 includes a lower end 124*a* that may be threadably mated to an upper end 124*b* of a lower tubular. During installation or disassembly, the backup tong 122 may rotationally and translationally secure the upper end 124*b* in a stationary position while the primary tong 118 applies rotational torque to the lower end 124*a*. The primary tong 118 may translate vertically with the lower end 124*a* as it is threaded or unthreaded from the upper end 124*b*. Accordingly, many operations may require hydraulic power to be provided to both the primary tong 118 and backup tong 122 simultaneously.

The operation of the hydraulic power tongs 102 may be performed locally via one or more controls 126. As illustrated, the one or more controls 126 may include, but are not limited to, levers which may be manually operated to control hydraulic power to the hydraulic power tongs 102. However, it will be appreciated that the levers may be replaced with any type of controls suitable for selectively conveying the hydraulic power to the hydraulic power tongs 102.

In some applications, the controls 126 may be positioned at or near the primary tong 118 for control by an operator 128 present on the rig floor 104. In some embodiments, safety procedures require the absence of any additional personnel besides the operator 128 near the hydraulic power tongs 102 during operation. However, the operator 128 may be at risk of unintentional activation or inadvertent operation of the hydraulic power tongs 102, which may cause the hydraulic power tongs 102 to rotate, actuate, clamp, or translate within the frame 114. Due to the high power produced by the hydraulic system, unintentional activation of the hydraulic power tongs 102 may lead to serious injury or even death to the operator 128.

Figure 2:
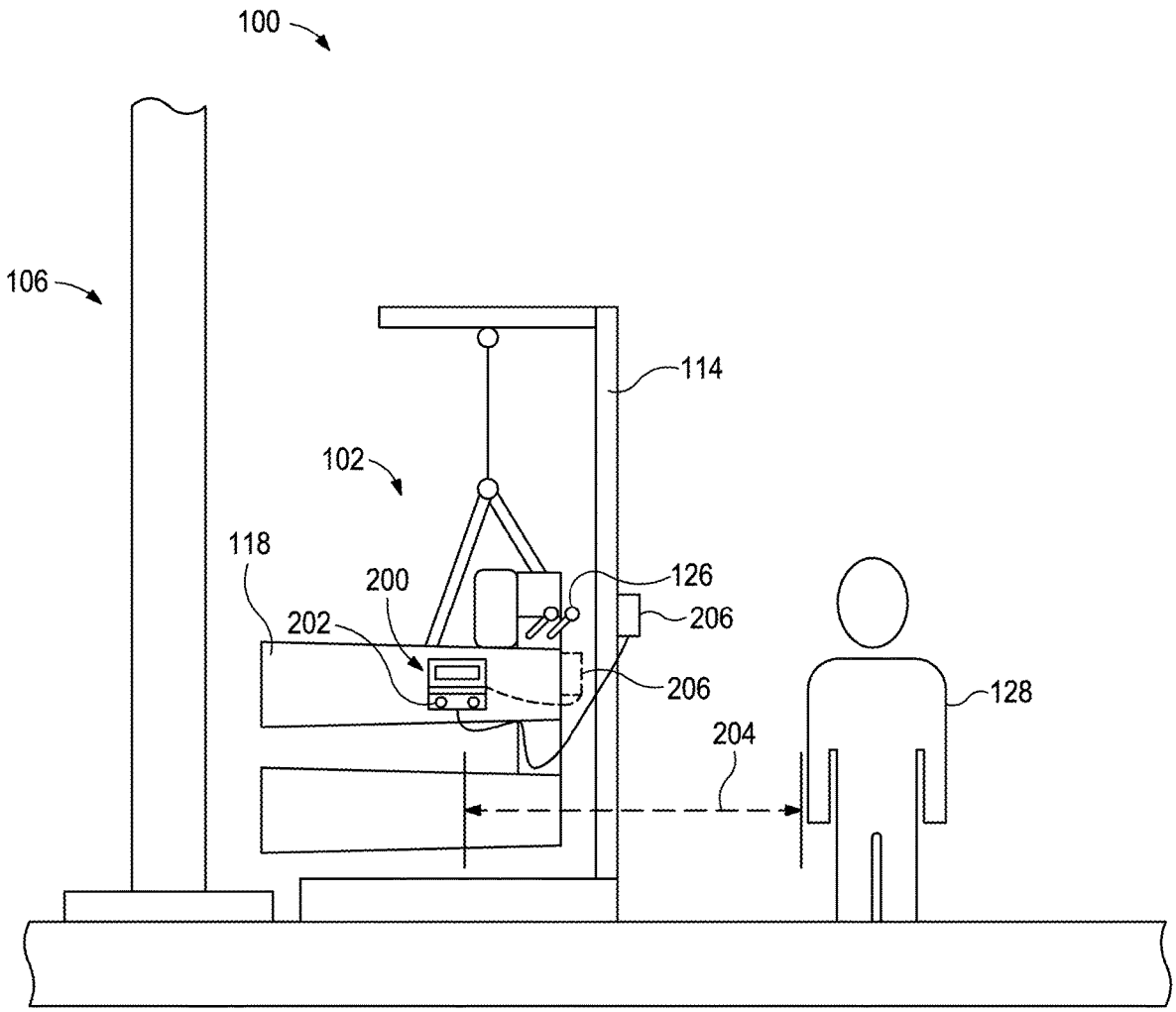
FIG. 2 is a schematic view of the rig floor with an electronic limit barrier device installed on the hydraulic power tongs, according to an embodiment of the present disclosure.

FIG. 2 is a schematic view of the well system 100 with an electronic limit barrier device 200, according to an embodiment of the present disclosure. As discussed above, the unintentional activation or inadvertent operation of the hydraulic power tongs 102 when the operator 128 is in the vicinity of the hydraulic power tongs 102 may lead to serious injury. As such, the electronic limit barrier device 200 (hereinafter, "the device 200") may be included for added safety to the operator 128. In some embodiments, the device 200 may be installed on the hydraulic power tongs 102, such as on an exterior surface of the primary tong 118 at or near the controls 126.

In some embodiments, the device 200 may be configured to monitor a real-time location of the operator 128 relative to the location of the device 200. To accomplish this, the device 200 may include one or more sensors 202, which may include, but are not limited to, ultrasonic distance or proximity sensors, infrared distance or proximity sensors, laser distance sensors, capacitive proximity sensors, mechanical limit switches, or any combination thereof. The device 200 may utilize the sensors 202 for determining a distance 204 between the device 200 and the operator 128, and thereby determining a distance between the operator 128 and the hydraulic power tongs 102. In some embodiments, the sensors 202 are distance sensors which may determine a continuous (real-time) distance 204 between the operator 128 and the hydraulic power tongs 102 during operation. In alternate embodiments, however, the sensors 202 may be proximity sensors that detect when the operator is detected within a predefined or "cut-off" distance measured from the device 200.

Based upon the distance 204 determined by the sensors 202, the device 200 may generate and transmit a cut-off signal to cease operation of the hydraulic power tongs 102. More specifically, the device 200 may be in communication with a hydraulic control valve 206 and may provide the cut-off signal directly to the hydraulic control valve 206. In some embodiments, the hydraulic control valve 206 may be positioned on or within the hydraulic power tongs 102 for self-contained hydraulic systems. In alternate embodiments, however, the hydraulic control valve 206 may be positioned on the frame 114, or otherwise externally contained within an existing hydraulic system. Regardless of placement, the cut-off signal generated by the device 200 may trigger the hydraulic control valve 206 to dump (release) hydraulic fluid and/or pressure to prevent further operation of the hydraulic power tongs 102.

In a non-limiting example, the device 200 may be calibrated to generate a cut-off signal if the operator 128 is about 10 centimeters or less from the device 200. Accordingly, the device 200 may be installed greater than about 10 centimeters from the controls 126. Further, the cut-off distance may be variably programmed within the device 200, such that the distance may be greater than about 10 centimeters or less than about 10 centimeters without departing from the scope of this disclosure. Thus, the operator 128 may be able to routinely utilize the controls 126 without triggering a shut-off, but will trigger a cut-off signal from the device 200 upon approaching the tubular 106 or a front (e.g., the working or operative end) of the primary tong 118. In this way, the device 200 may act as an electronic limit barrier which automatically prevents operation of the hydraulic power tongs 102 if an operator 128 approaches the operative end of the primary tong 118 and otherwise breaches the predefined cut-off distance. By activating the hydraulic control valve 206 and thereby rendering the hydraulic power tongs 102 temporarily inoperable, the electronic limit barrier generated by the device 200 may prevent injury or death of an operator 128 from unintentional activation of the hydraulic power tongs 102.

Figure 3:
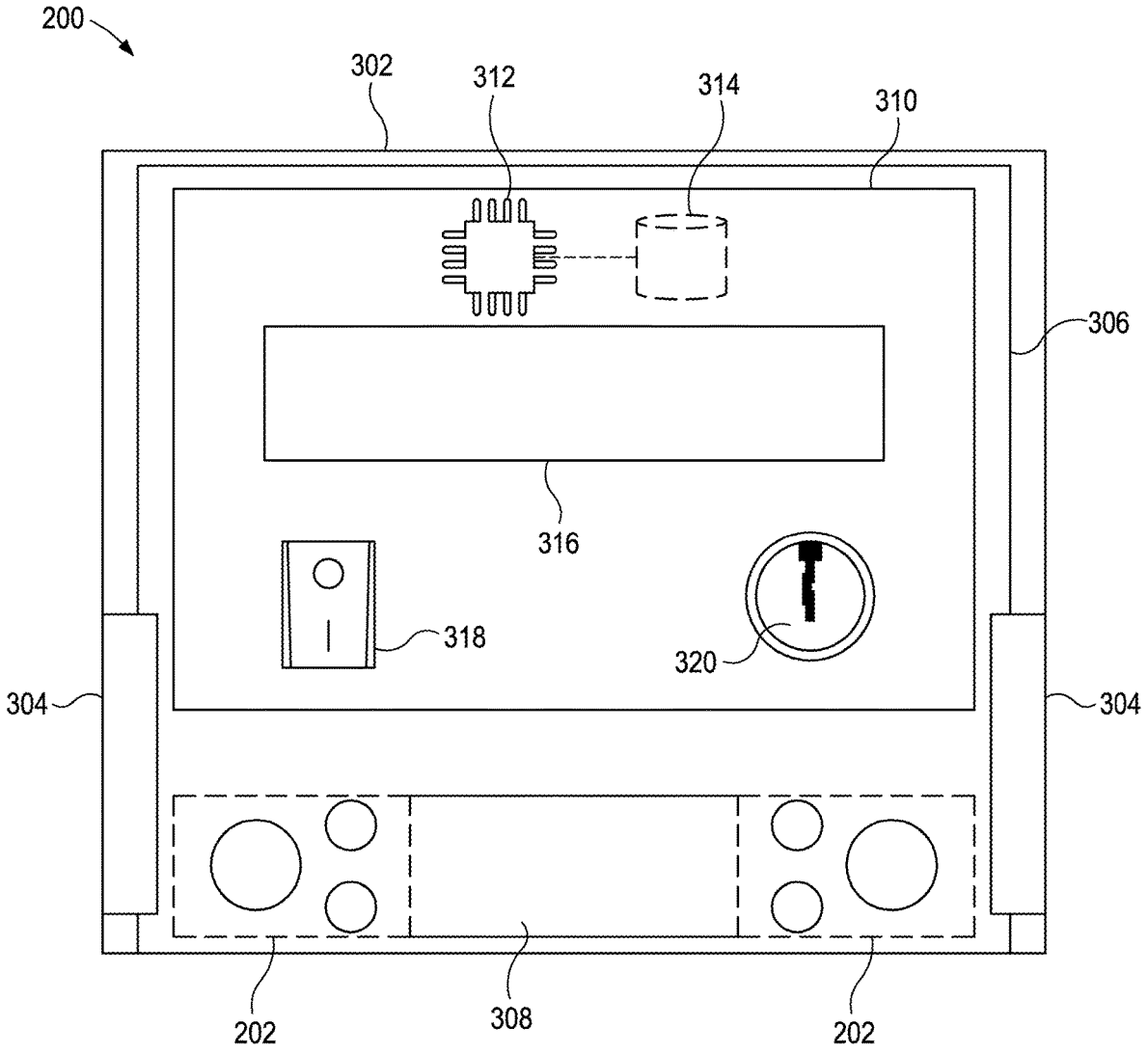
FIG. 3 is a schematic view of the electronic limit barrier device, according to an embodiment of the present disclosure.

FIG. 3 is a schematic view of one example of the electronic limit barrier device 200, according to one or more embodiments of the present disclosure. As illustrated, the device 200 may include a base plate 302 that may installed on hydraulic power tongs (e.g., the hydraulic power tongs 102 of FIGS. 1-2). Attachment means for installation of the base plate 302 may include, but are not limited to, one or more mechanical fasteners, adhesives, welding, brazing, hook and loop fasteners, magnetic attachment means, or any combination thereof. The device 200 may include one or more tilting adapters 304, such as adjustable angle hinges, extending from the base plate 302 that may be used to orient the device 200 to a desired orientation relative to an operator during operation. A housing 306 may be pivotably coupled to the tilting adapters 304, such that the housing 306 may be rotated or pivoted on the base plate 302. Rotation or pivoting of the housing 306 may enable orientation of the device 200 towards the power tong controls (e.g., the controls 126 of FIGS. 1-2), or any location where an operator may be positioned.

The housing 306 may include a sensor bar 308 which may include the one or more sensors 202. As discussed above, the sensors 202 may include proximity or distance sensors for determining when an operator is within an unsafe, or predefined cutoff, distance. The sensors 202 may be included on the sensor bar 308 such that orientation of the housing 306 may aim the sensors 202 toward an operator. The housing 306 may further include a control panel 310 that is in communication with the sensor bar 308. The control panel 310 may receive and process signals from the sensor bar 308 to determine if system shutoff should occur.

The control panel 310 may also include a controller 312 for executing monitoring and shutoff functions for the device 200. In some embodiments, the controller 312 may be a processor for advanced computations and operations, however, the controller 312 may also include a control circuit on a printed circuit board or breadboard. In some embodiments, the controller 312 may be in communication with a database or storage 314. The storage 314 may store one or more sets of computer-readable instructions executable by the controller to monitor operator distance with signals from the sensor bar 308 and instruct the creation of a cut-off signal based upon the monitored distance. The controller 312 may execute these instructions and may be in communication with both the sensor bar 308 and a hydraulic control valve (e.g., the hydraulic control valve 206 of FIG. 2).

The control panel 310 may further include a screen 316 for displaying information to the operator regarding distances and cut-off signals. In some embodiments, the screen 316 may be a liquid crystal display (LCD) screen which may enable text readouts of the real-time status of the device 200. The screen 316 may provide information including, but not limited to, the currently determined (measured) distance, whether the operator is within the predefined cutoff distance, the active status of the hydraulic power tongs, or any combination thereof. In some embodiments, the control panel 310 may include a power switch 318 operable to activate the device 200. If the power switch 318 is placed in an "off" position, the hydraulic power tongs may operate without the added safety barrier and operability provided by the device 200. If the power switch 318 is placed in an "on" position, the device 200 will be active and may monitor operator distance and control the flow of hydraulic fluid to the power tongs. The control panel 310 may further include an override key switch 320 that is operable to disable some or all of the functionality of the device 200. While the power switch 318 may cease operation of the device 200, the override key switch 320 may enable continued distance monitoring without generating a cut-off signal.

Figure 4:
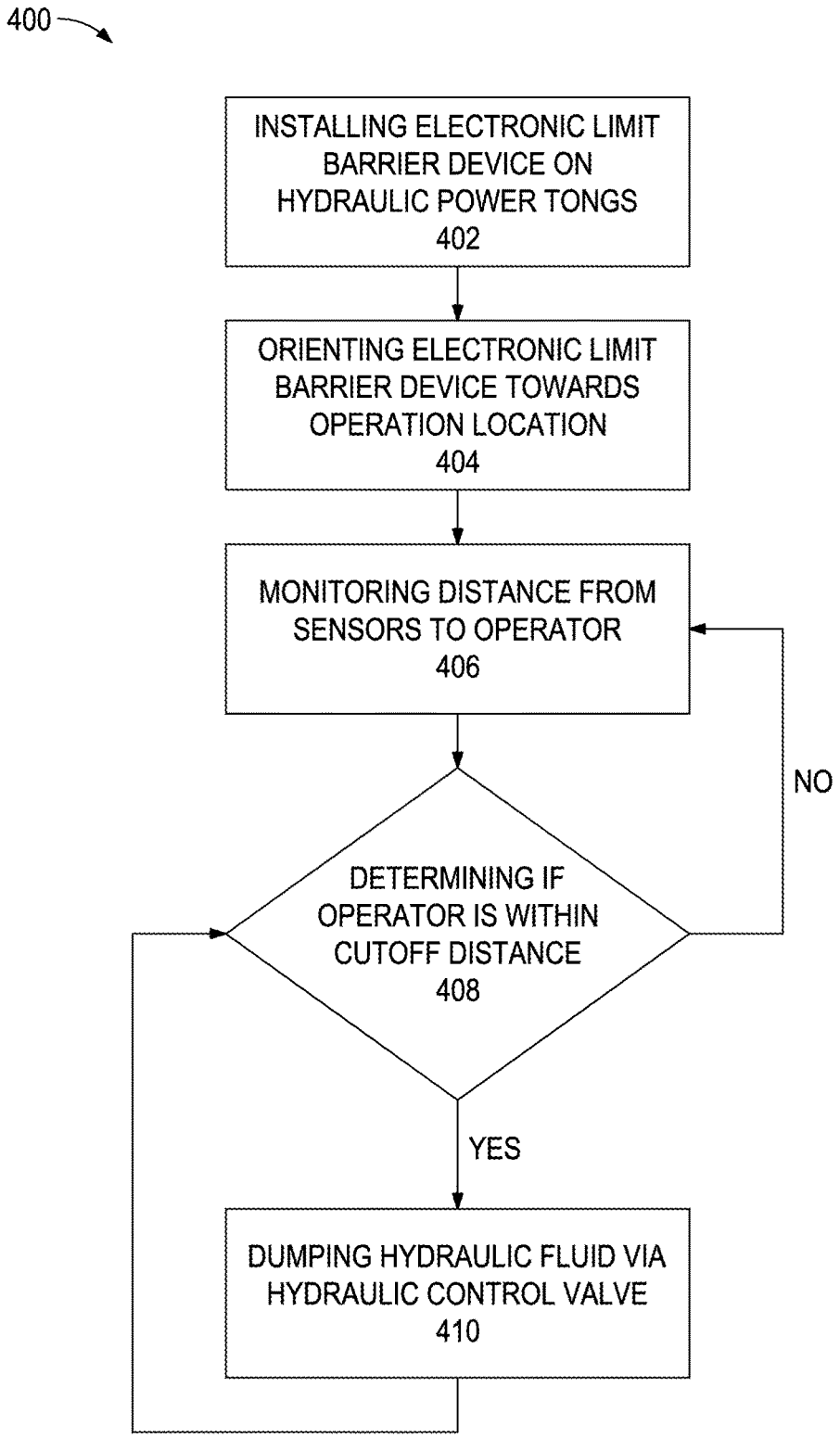
FIG. 4 is a flowchart illustrating a method for installing and operating an electronic limit barrier device on hydraulic power tongs.

FIG. 4 is a schematic flowchart illustrating an example method 400 for installing and operating an electronic limit barrier device on hydraulic power tongs. The method 400 may begin at 402 with installing an electronic limit barrier device (e.g., the electronic limit barrier device 200 of FIGS. 2-3) on an external surface of hydraulic power tongs (e.g., hydraulic power tongs 102 of FIGS. 1-2). As discussed above, a base plate (e.g., the base plate 302 of FIG. 3) may be attached to a primary tong (e.g., the primary tong 118 of FIG. 1-2) via one or more attachment means. The electronic limit barrier device may be installed a pre-defined distance from one or more controls (e.g., the controls 126 of FIGS. 1-2) such that distance from an operator (e.g., the operator 128 of FIGS. 1-2) may be monitored while enabling operation of the hydraulic power tongs. Installing the electronic limit barrier device at 402 may further include communicatively coupling the electronic limit barrier device to a hydraulic control valve (e.g., the hydraulic control valve 206 of FIG. 2). Installing the electronic limit barrier device at 402 may further include programming the electronic limit barrier device with a predetermined cut-off distance, such that an operator or installer may program a cut-off distance based upon an application or location of the electronic limit barrier device.

The method 400 may further include orienting the electronic limit barrier device towards an operator location, as at 404. The electronic limit barrier device may include a housing (e.g., the housing 306 of FIG. 3) which may be pivoted or otherwise oriented on the base plate to aim one or more sensors (e.g., the sensors 202 of FIGS. 2 and 3) towards the operator. During installation at 402, the electronic limit barrier device may be naturally oriented away from the controls due an angled face of the primary tong. As such, at 404 the electronic limit barrier device may be pivoted such that the sensors are aimed towards the controls.

The method 400 may further include monitoring a distance (e.g., the distance 204 of FIG. 2) from the electronic limit barrier device to the operator, as at 406. The distance may be determined by the electronic limit barrier device based upon readouts or signals provided by the one or more sensors to a controller (e.g., the controller 312 of FIG. 3) of the electronic limit barrier device. In some embodiments, the method 400 may further include displaying the monitored distance on a screen (e.g., the screen 316 of FIG. 3) of the electronic limit barrier device at 406. The method 400 may continue at 408 with determining if the operator is within a pre-defined cutoff distance. The controller of the electronic limit barrier device may compare the distance determined at 406 with the pre-defined cutoff distance at 408. In a non-limiting example, the pre-defined cutoff distance may be about 10 centimeters from the electronic limit barrier device.

If the monitored distance is determined to not be within the cutoff distance at 408, the method 400 may continue at 406 with continued monitoring of the distance between the sensors and the operator. As such, the method 400 may continue to loop and constantly monitor the real-time distance to the operator. However, if the monitored distance is determined to be within the cutoff distance at 408, the method 400 may continue at 410 with releasing hydraulic fluid via the hydraulic control valve. At 410, the electronic limit barrier device may generate a cut-off signal which may be communicated to the hydraulic control valve. The cut-off signal may trigger an immediate release of hydraulic fluid via the hydraulic control valve, thus rendering the hydraulic power tongs inoperable.

The method 400 may continue at 408 with a subsequent determination if the operator is within the cutoff distance. If the operator remains within the cutoff distance at 408, the method may return to 410 and continue dumping (releasing) hydraulic fluid to prevent injury to the operator. If the operator is no longer within the cutoff distance at 408, the method may return to 406 for continued monitoring without dumping (releasing) further hydraulic fluid. As such, the method 400 may maintain inoperability of the hydraulic power tongs while the operator is within the cutoff distance, and may continue monitoring the distance after the operator returns to a safe distance.

In view of the structural and functional features described above, example method 400 will be better appreciated with reference to FIGS. 1-3. While, for purposes of simplicity of explanation, the example method of FIG. 4 is shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement the method, and conversely, some actions may be performed that are omitted from the description.

Embodiments disclosed herein include:

A. A system, comprising hydraulic power tongs mounted to a rig floor and including a primary tong and one or more controls for operating the primary tong; an electronic limit barrier device including one or more sensors operable to determine a distance between the hydraulic power tongs and an operator on the rig floor; and a hydraulic control valve in communication with the electronic limit barrier device and fluidly coupled to the hydraulic power tongs, wherein the electronic limit barrier device is programmed to: compare the distance to a pre-defined cutoff distance, and release hydraulic fluid from the hydraulic power tongs upon determining that the distance is less than or equal to the pre-defined cutoff distance.

B. A method, comprising activating an electronic limit barrier device on a rig floor including hydraulic power tongs; monitoring a distance between an operator on the rig floor and the hydraulic power tongs using one or more sensors included in the electronic limit barrier device; determining with a controller of the electronic limit barrier device if the distance is less than or equal to a pre-defined cutoff distance; sending a cut-off signal to a hydraulic control valve with the controller when the distance is less than or equal to the pre-defined cutoff distance; and releasing hydraulic fluid from the hydraulic power tongs upon receipt of the cut-off signal, and thereby disabling the hydraulic power tongs.

C. An electronic limit barrier device, comprising one or more sensors configured to determine a distance between the electronic limit barrier device and an operator present on a rig floor that includes hydraulic power tongs; and a controller communicably coupled to the one or more sensors and a hydraulic control valve, wherein the controller is programmed to generate a cut-off signal to the hydraulic control valve based upon the distance determined by the one or more sensors, and wherein the cut-off signal triggers release of hydraulic fluid to the hydraulic power tongs via the hydraulic control valve.

Each of embodiments A through C may have one or more of the following additional elements in any combination: Element 1: wherein the electronic limit barrier device is mounted to the hydraulic power tongs. Element 2: wherein the electronic limit barrier device is mounted to the hydraulic power tongs via an attachment means selected from the group consisting of a mechanical fastener, an adhesive, welding, brazing, a hook and loop fastener, a magnetic attachment, and any combination thereof. Element 3: wherein the one or more sensors include a proximity sensor operable to detect when the operator is present within the pre-defined cutoff distance. Element 4: wherein the electronic limit barrier device transmits a cut-off signal to the hydraulic control valve when the distance is less than or equal to the pre-defined cutoff distance. Element 5: wherein the pre-defined cutoff distance is about 10 centimeters. Element 6: wherein the hydraulic power tongs are configured to receive one or more tubulars selected from the group consisting of production tubing, well casing, drill pipe, drilling risers, sucker rods, and any combination thereof. Element 7: wherein activating the electronic limit barrier device is preceded by installing the electronic limit barrier device on the hydraulic power tongs. Element 8: wherein installing the electronic limit barrier device includes attaching a base plate of the electronic limit barrier device to an exterior surface of the hydraulic power tongs. Element 9: further comprising orienting a housing pivotably coupled to the base plate toward controls for the hydraulic power tongs.

Element 10: wherein activating the electronic limit barrier device is preceded by programming the electronic limit barrier device with the pre-defined cutoff distance.

Element 11: wherein the controller is programmed to compare the distance to a pre-defined cutoff distance. Element 12: further comprising: a base plate; and a housing pivotably coupled to the base plate via one or more tilting adapters and configured to house the one or more sensors and the controller. Element 13: wherein the base plate is mountable to the hydraulic power tongs. Element 14: wherein the housing includes a screen in communication with the controller to display real-time information. Element 15: wherein the hydraulic control valve provides hydraulic fluid to the hydraulic power tongs, and releasing the hydraulic fluid via the hydraulic control valve ceases operation of the hydraulic power tongs. Element 16: wherein the one or more sensors are selected from the group consisting of ultrasonic distance or proximity sensors, infrared distance or proximity sensors, laser distance sensors, capacitive proximity sensors, mechanical limit switches, and any combination thereof. Element 17: further comprising an override key switch configured to disable generation of the cut-off signal.

By way of non-limiting example, exemplary combinations applicable to A through C include: Element 1 with Element 2; Element 7 with Element 8; Element 8 with Element 9; Element 12 with Element 13; and Element 13 with Element 14.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system, comprising:

hydraulic power tongs mounted to a rig floor and including a primary tong and one or more controls for operating the primary tong;

an electronic limit barrier device including one or more sensors operable to determine a distance between the hydraulic power tongs and an operator on the rig floor; and a hydraulic control valve in communication with the electronic limit barrier device and fluidly coupled to the hydraulic power tongs, wherein the electronic limit barrier device is programmed to:

compare the distance to a pre-defined cutoff distance, and release hydraulic fluid from the hydraulic power tongs upon determining that the distance is less than or equal to the pre-defined cutoff distance.

2. The system of claim 1, wherein the electronic limit barrier device is mounted to the hydraulic power tongs.

3. The system of claim 2, wherein the electronic limit barrier device is mounted to the hydraulic power tongs via an attachment means selected from the group consisting of a mechanical fastener, an adhesive, welding, brazing, a hook and loop fastener, a magnetic attachment, and any combination thereof.

4. The system of claim 1, wherein the one or more sensors include a proximity sensor operable to detect when the operator is present within the pre-defined cutoff distance.

5. The system of claim 1, wherein the electronic limit barrier device transmits a cut-off signal to the hydraulic control valve when the distance is less than or equal to the pre-defined cutoff distance.

6. The system of claim 1, wherein the pre-defined cutoff distance is about 10 centimeters.

7. The system of claim 1, wherein the hydraulic power tongs are configured to receive one or more tubulars selected from the group consisting of production tubing, well casing, drill pipe, drilling risers, sucker rods, and any combination thereof.

8. A method, comprising:

activating an electronic limit barrier device on a rig floor including hydraulic power tongs;

monitoring a distance between an operator on the rig floor and the hydraulic power tongs using one or more sensors included in the electronic limit barrier device;

determining with a controller of the electronic limit barrier device if the distance is less than or equal to a pre-defined cutoff distance;

sending a cut-off signal to a hydraulic control valve with the controller when the distance is less than or equal to the pre-defined cutoff distance; and releasing hydraulic fluid from the hydraulic power tongs upon receipt of the cut-off signal, and thereby disabling the hydraulic power tongs.

9. The method of claim 8, wherein activating the electronic limit barrier device is preceded by installing the electronic limit barrier device on the hydraulic power tongs.

10. The method of claim 9, wherein installing the electronic limit barrier device includes attaching a base plate of the electronic limit barrier device to an exterior surface of the hydraulic power tongs.

11. The method of claim 10, further comprising orienting a housing pivotably coupled to the base plate toward controls for the hydraulic power tongs.

12. The method of claim 8, wherein activating the electronic limit barrier device is preceded by programming the electronic limit barrier device with the pre-defined cutoff distance.

13. An electronic limit barrier device, comprising:

one or more sensors configured to determine a distance between the electronic limit barrier device and an operator present on a rig floor that includes hydraulic power tongs; and a controller communicably coupled to the one or more sensors and a hydraulic control valve, wherein the controller is programmed to generate a cut-off signal to the hydraulic control valve based upon the distance determined by the one or more sensors, and wherein the cut-off signal triggers release of hydraulic fluid to the hydraulic power tongs via the hydraulic control valve.

14. The electronic limit barrier device of claim 13, wherein the controller is programmed to compare the distance to a pre-defined cutoff distance.

15. The electronic limit barrier device of claim 13, further comprising:

a base plate; and a housing pivotably coupled to the base plate via one or more tilting adapters and configured to house the one or more sensors and the controller.

16. The electronic limit barrier device of claim 15, wherein the base plate is mountable to the hydraulic power tongs.

17. The electronic limit barrier device of claim 15, wherein the housing includes a screen in communication with the controller to display real-time information.

18. The electronic limit barrier device of claim 13, wherein the hydraulic control valve provides hydraulic fluid to the hydraulic power tongs, and releasing the hydraulic fluid via the hydraulic control valve ceases operation of the hydraulic power tongs.

19. The electronic limit barrier device of claim 13, wherein the one or more sensors are selected from the group consisting of ultrasonic distance or proximity sensors, infrared distance or proximity sensors, laser distance sensors, capacitive proximity sensors, mechanical limit switches, and any combination thereof.

20. The electronic limit barrier device of claim 13, further comprising an override key switch configured to disable generation of the cut-off signal.

* * * * *